US005704542A

United States Patent [19]

Harrelson

[11] Patent Number: 5,704,542

[45] Date of Patent: Jan. 6, 1998

[54] WRAP-AROUND CARRIER WITH IMPROVED LOCKING MEANS

[75] Inventor: Glen R. Harrelson, Gainsville, Ga.

[73] Assignee: Riverwood International Corporation, Atlanta, Ga.

[21] Appl. No.: 788,307

[22] Filed: Jan. 24, 1997

[51] Int. Cl.[6] ..... B65D 5/42

[52] U.S. Cl. ..... 229/198.2; 206/140; 229/103.2

[58] Field of Search ..... 229/103.2, 198.2; 206/140, 427

[56] References Cited

U.S. PATENT DOCUMENTS

| | | | |
|---|---|---|---|
| 4,498,618 | 2/1985 | Sutherland | 229/198.2 |
| 4,611,754 | 9/1986 | Sutherland | 229/198.2 |
| 4,679,725 | 7/1987 | Wilson | 229/103.2 |
| 4,708,284 | 11/1987 | Sutherland et al. | 229/198.2 |
| 5,004,147 | 4/1991 | Bienaime | 229/198.2 |
| 5,443,203 | 8/1995 | Sutherland | 229/103.2 |
| 5,588,586 | 12/1996 | Negelen | 229/103.2 |

FOREIGN PATENT DOCUMENTS

| | | | |
|---|---|---|---|
| 294342 | 4/1965 | Netherlands | 206/140 |

*Primary Examiner*—Gary E. Elkins

[57] ABSTRACT

A wrap-around carrier having primary and secondary locks for connecting the bottom panel flaps together. The female locking openings are contained in female locking flaps which have been folded out of one of the bottom panel flaps through an angle of 180°. The corresponding male locking tabs are connected to a male locking panel. The bottom panel flaps are spaced apart, with the male and female locking panels spanning the space between the flaps.

17 Claims, 3 Drawing Sheets

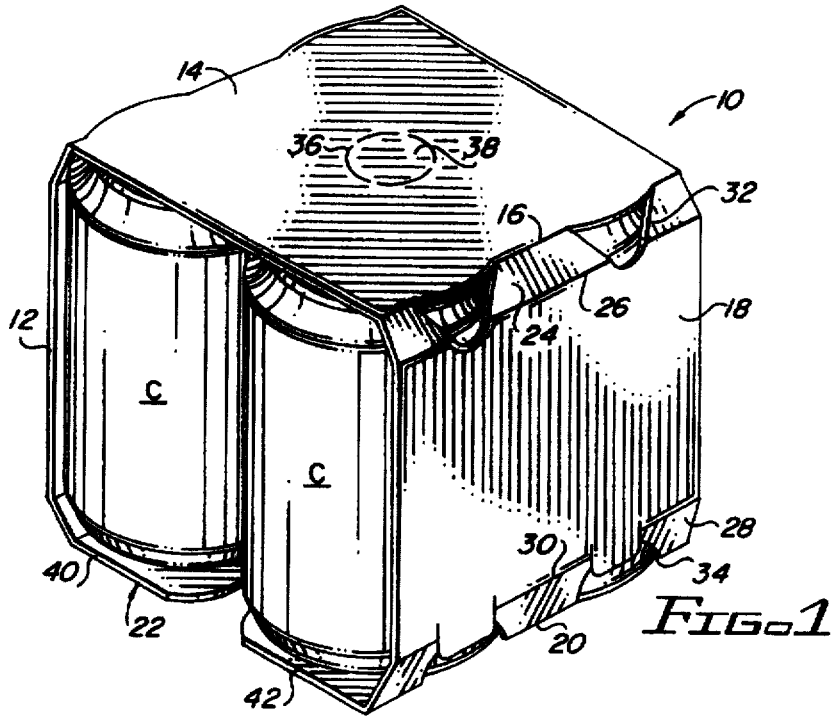
FIG. 1
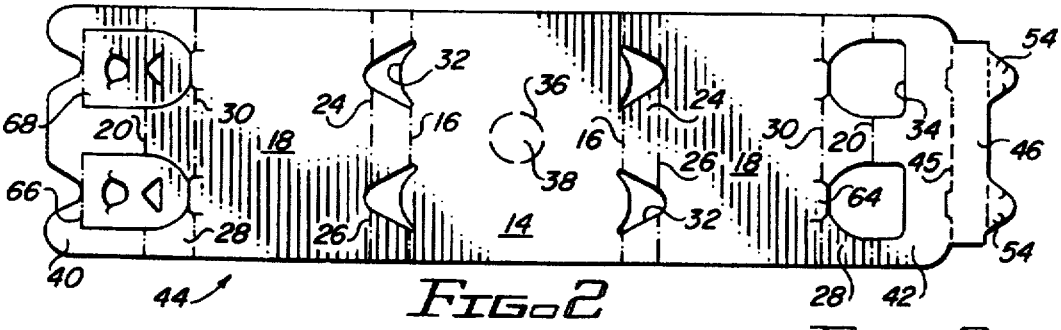
FIG. 2
FIG. 3
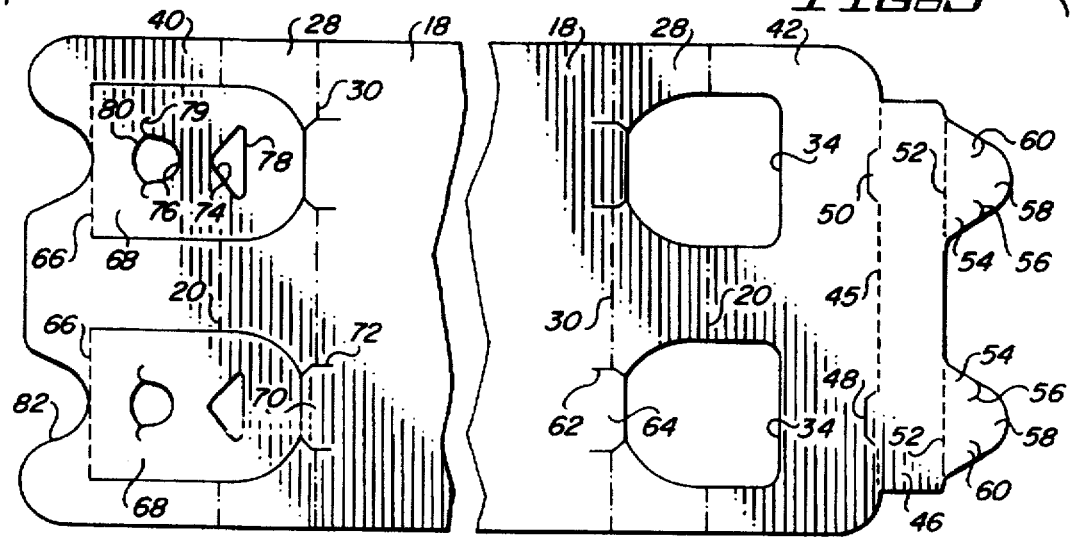

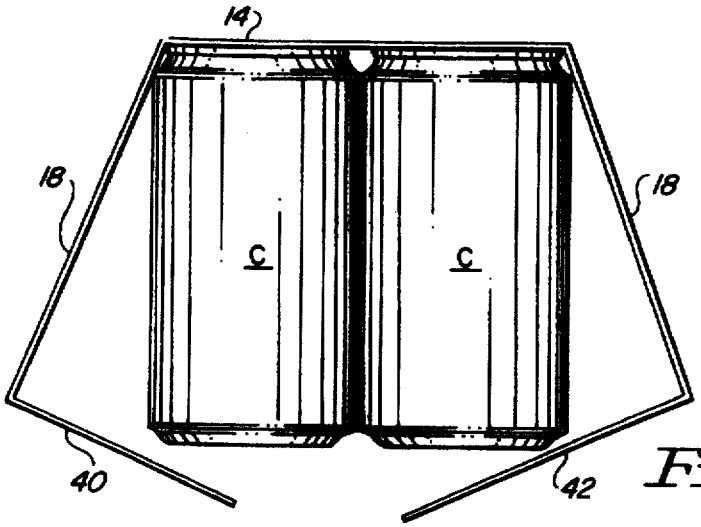
FIG. 4
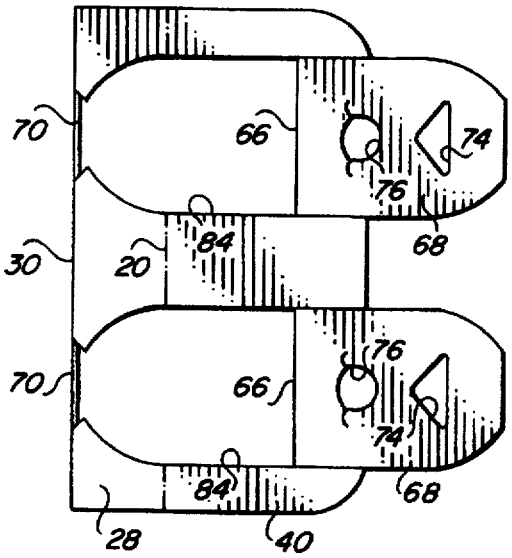
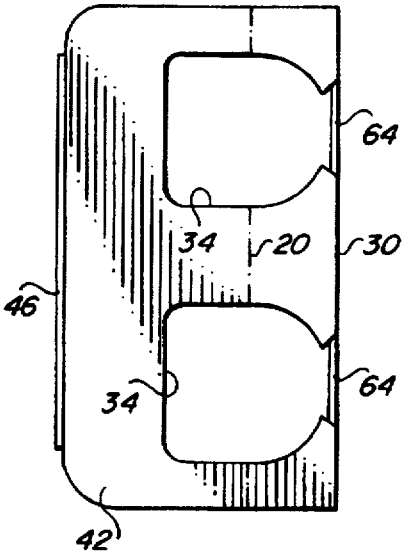
FIG. 5
FIG. 6
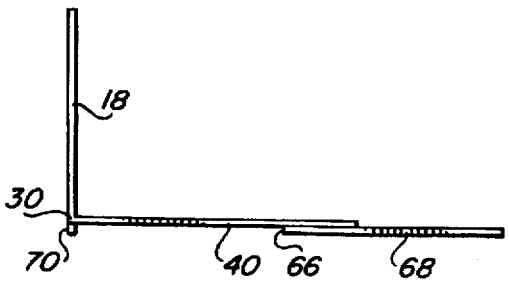
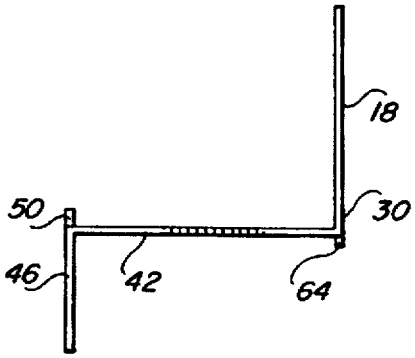

WRAP-AROUND CARRIER WITH IMPROVED LOCKING MEANS

FIELD OF THE INVENTION

This invention relates to a mechanical lock for securing two flaps together to form a panel of a carton. More particularly, it relates to a mechanical lock adapted for use in a wrap-around carrier.

BACKGROUND OF THE INVENTION

Wrap-around carriers or cartons are commonly used to package beverage containers as well as other types of articles. To form a package the centrally located top panel section of a carrier blank is normally positioned on a group of articles to be packaged and the side panel sections are folded down. Bottom panel flaps at opposite ends of the blank are then folded into place, with one of the flaps partially overlapping the other. Although the bottom panel flaps in some carriers are glued to each other, integral mechanical locks are commonly employed to connect the flaps together. Typically, primary locking tabs on one of the flaps engage an edge of a primary locking opening in the other flap, and secondary locking tabs are secured in secondary locking openings to prevent the primary locks from separating.

A variety of locking mechanism designs have been used over the years. While many of the designs are capable of adequately locking bottom panel flaps together, it would nevertheless be desirable to provide an improved locking mechanism which not only locks the bottom panel flaps in place and prevents them from separating, but also reduces the cost of the carton by reducing the material usage of the carrier. In addition, the locking mechanism should be such that the bottom panels can be locked together by existing packaging machinery.

It is an object of the invention to provide a panel locking mechanism which meets these criteria.

BRIEF SUMMARY OF THE INVENTION

The invention is incorporated in a carton which includes a panel formed from a pair of mechanically connected spaced flaps. At least one female locking panel connected by a fold line to one of the flaps has been folded out of the flap so that it is substantially parallel to it. The female locking panel extends past the end of its associated flap and contains a locking opening therein. A locking tab connected to the other panel flap extends into the locking opening in locking engagement therewith.

In a preferred arrangement the locking tab is an integral portion of a male locking panel which is foldably connected to the second panel flap. Typically, the pair of flaps are the flaps of the bottom panel of a wrap-around carrier, and the locking panels include a secondary locking opening and tab arrangement.

In addition to providing a strong secure lock to hold the bottom panel flaps together, the carrier is economical to produce, aided by the fact that the female locking flap, when folded into operative position, creates an opening in the associated bottom panel flap which functions as a heel cutout. These and other aspects and benefits of the invention will readily be apparent from the more detailed description of the preferred embodiment of the invention which follows.

BRIEF DESCRIPTION OF THE DRAWINGS

FIG. 1 is a pictorial view of a wrap-around carrier incorporating the locking mechanism of the invention;

FIG. 2 is a plan view of a blank for forming the carrier of FIG. 1;

FIG. 3 is a partial enlarged view of the blank of FIG. 2, showing the locking panels at the ends of the blank in more detail;

FIG. 4 is an end view of an initial stage of the formation of a carrier from the blank of FIG. 2;

FIG. 5 is an enlarged plan view of the underside of the carrier, omitting the articles being packaged for the sake of clarity, at a slightly later stage of carrier formation;

FIG. 6 is an end view of the interim form of carrier shown in FIG. 5;

DETAILED DESCRIPTION OF THE PREFERRED EMBODIMENTS

Figure 7:
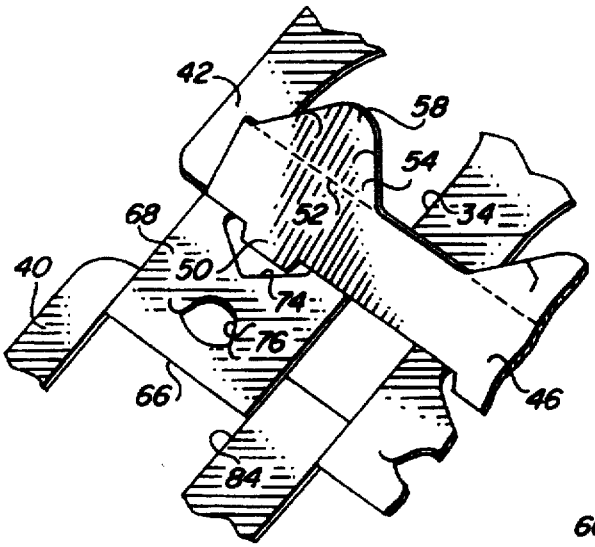
FIG. 7 is a partial pictorial view of the bottom panel flaps of the carrier at an initial stage of formation of one of the bottom panel locks.

Referring to FIG. 1, the invention is incorporated in package 10, which is comprised of wrap-around carrier 12 containing four beverage cans C. The carrier is of basic wrap-around design, including a top panel 14 connected by fold lines 16 to side panels 18, which in turn are connected by fold lines 20 to bottom panel 22. Included in the side panels are sloped shoulder panel sections 24, defined by fold lines 16 and 26, and sloped heel panel sections 28, defined by fold lines 20 and 30. Can lid cutouts 32 are provided in the shoulder panel sections 24 and heel cutouts 34 are provided in the heel panel sections 28. As noted later, the heel cutouts also extend into the bottom panel. A finger hole 36 covered by separable tab 38 is provided in the top panel for use as a grip for lifting the carrier. As described in more detail below, the bottom panel is formed from flaps 40 and 42 which are connected to each other by the mechanical locking means of the invention.

A blank 44 for forming the carrier is shown in FIG. 2 as comprising a generally rectangular sheet of flexible material possessing sufficient stiffness and strength to make it capable of withstanding the stresses to which the carrier is subjected during packaging and use. Paperboard of the type normally associated with the carrier industry is preferred. The top panel section 14 is substantially centrally located in the sheet between the shoulder panel portions 24 of side panel sections 18, and the bottom panel flaps 40 and 42 are connected to the heel panel portions 28 of the side panel sections.

Referring also to FIG. 3, which shows the ends of the blank in greater detail, the bottom panel flap 42 is connected by fold line 45 to male locking panel 46. The fold line 45 is substantially parallel to the bottom panel fold line 20, and is interrupted by two spaced slits 48 which form primary locking tabs 50. Connected to the locking panel 46 by spaced fold lines 52 are secondary locking tabs 54. Each secondary locking tab 54 is located opposite a primary locking tab 50 and includes two generally L-shaped slits 56 which form an outer secondary locking tab portion 58 and two spaced shoulder tabs 60. The heel cutouts 34 extend throughout the major portion of the width of the associated heel panel section 28 and for a substantial distance into the bottom panel flap 42. In addition, spaced slits 62 in the side panel section 18 extend to the inner edge of the heel cutouts 34 to form tabs 64 which are arranged so as to contact the sides of packaged cans just above the heel cutouts.

The bottom panel flap 40 includes spaced fold lines 66 which connect the bottom panel flap to female locking panels 68. Each female locking panel is of the same width as, but longer than, the heel cutouts 34. Also, the female locking panels 68 extend to the edge of tabs 70 which are similar to the tabs 64. Like the tabs 64, the tabs 70 are formed by spaced slits 72 in the adjacent side panel section 18. Each female locking panel 68 includes a primary female lock 74 and a secondary female lock 76 located outwardly of the primary female lock. The primary female lock 74 is an opening which includes an inner edge 78 substantially parallel to the fold line 30. The secondary female lock 76 is an opening comprised of a generally U-shaped edge terminating in oppositely located outwardly directed slits 79. Connecting the slits 79 is a slightly convex edge 80. The adjacent end of the blank may be provided with recesses 82 shaped similarly to the secondary male locking tabs 56 to allow nesting of the blanks during production of the blanks from a continuous web.

To form a package, the articles are segregated into the desired final arrangement and the blank is positioned so that the top panel section rests on top of the cans. The side panel sections and the bottom panel flaps are then folded in the conventional manner. A typical point in this folding process is illustrated in FIG. 4. As the inward folding of the bottom panel flaps continues the female locking panels 68 are folded outwardly about fold lines 66 through an angle of substantially 180°. At the same time the male locking panel 46 is folded out about fold line 45 through an angle of 90° or more. FIGS. 5 and 6 illustrate the bottom panel flaps after these folding operations have been carried out but before the flaps have been brought together and connected by the mechanical locks. Note that the open areas 84 in the bottom panel flap 40 and the adjacent side panel heel portion 28 created by the folding of the female locking panels are similar to, although somewhat longer than, the heel cutouts 34. These open areas provide the same function as the heel cutouts 34.

Figure 8:
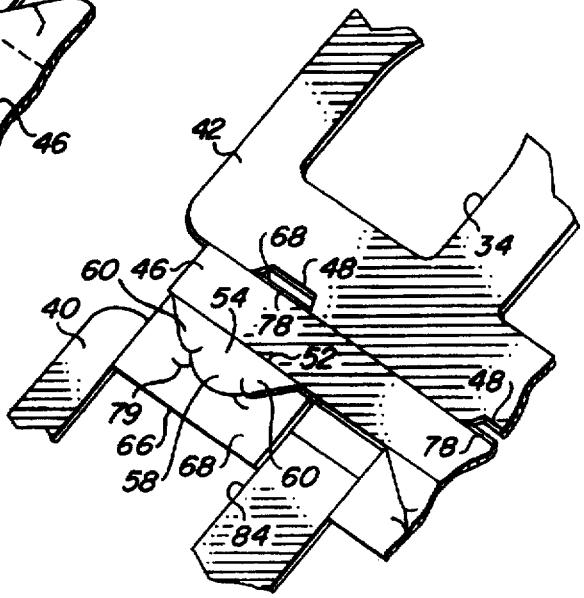
FIG. 8 is a partial pictorial view similar to that of FIG. 7, but showing the locking tabs at a later stage of lock formation.

When the bottom panel flaps have been pulled tightly about the articles just prior to activating the locking mechanism, the relative positions of the male locking panel 46 and the female locking panels 68 are as illustrated in FIG. 7. Both locking panels are still folded back, but the primary locking tab 50 is now poised over the edge 78 of the primary locking opening 74. Next, the male locking panel 46 is pivoted toward the female locking panel 68, causing the primary locking tabs 50 to enter the primary locking openings 74 and then contact the opposite face of the female locking panel 68. As this takes place the secondary male locking tabs 54 are pivoted about the fold lines 52 and positioned to enter the secondary female locking openings 76. The relative positions of the locking panel 42 and the secondary male locking tabs 54 at this point in the procedure are illustrated in FIG. 8. The male locking panel 46 is then moved to a position substantially parallel with the bottom panel flap 42, causing the outer portion 58 of the secondary locking tabs 54 to enter the secondary locking openings 76 and pass through the slits 79. The outer male locking tab portions 58 are moved to a position on the opposite side of the female locking panel 68 until the base of the tabs 60 prevents further movement. The primary and secondary locks at this point are now fully activated.

Figure 9:
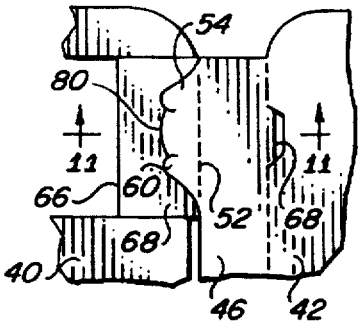
FIG. 9 is a partial plan view of the bottom panel of the finished carrier, showing the locking tabs in their final positions.
Figure 10:
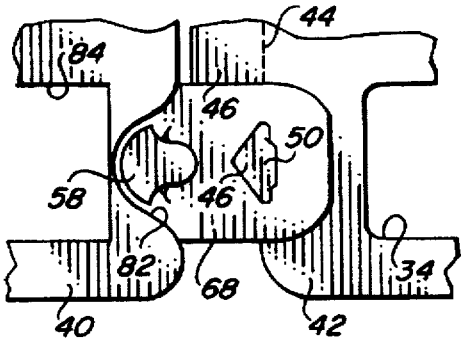
FIG. 10 is a partial plan view of the interior of the bottom panel of the finished carrier, with the packaged articles omitted.
Figure 11:
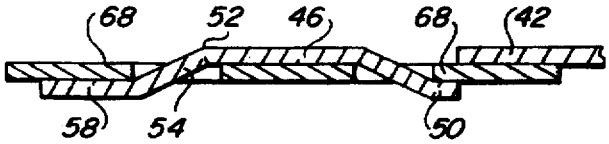
FIG. 11 is an enlarged transverse sectional view taken on line 11—11 of FIG. 9.

The final arrangement of the locks as they appear from the exterior of the carton is shown in FIG. 9. The final arrangement of the locks as they appear from the interior of the carton is shown in FIG. 10. The relationship of the locking elements in their final locked condition is illustrated in FIG. 11. Note in FIG. 10 that the recesses 82 in the female bottom panel 40 provide room for the outer portion 58 of the secondary locking tabs to move into place.

Although the various folding steps and the tightening step can be performed by hand, it is preferred to carry them out by conventional elements of a packaging machine, which are well known in the industry and need no further explanation or illustration. Although the panel locking process has been described in connection with the formation of an upright carton, it will be understood that the same principles would apply if the panel were formed with the carton inverted. Also, although described in connection with the packaging of beverage cans, the principles of the invention may be applied to carriers designed to package other types of articles.

It will be appreciated that the locking system of the invention provides the carrier with the structural integrity to support packaged articles without risk of failure of the locked panel flaps. Since the female locks are in locking panels which have been folded out of a bottom panel flap the width of the bottom panel flap can be substantially reduced, thus reducing the cost of the carrier material. The area of the bottom panel flap from which the female locking panels are obtained function as heel cutout areas. Normally the material cut out to form the heel cutout areas would be scrapped.

It should be understood that the invention is not limited to all the specific details described in connection with the preferred embodiment and that changes to certain features of the preferred embodiment which do not alter the overall basic function and concept of the invention may be made without departing from the spirit and scope of the invention defined in the appended claims.

What is claimed is:

1. In a carton including a panel formed from first and second panel flaps which are mechanically attached to each other, the improvement comprising:

the first and second panel flaps having spaced interior ends;

at least one female locking panel connected by a fold line to the first panel flap, the female locking panel and the first panel flap lying in different but substantially parallel planes, the female locking panel extending past the interior end of the first panel flap;

the female locking panel containing a locking opening therein; and a locking tab connected to the second panel flap;

the locking tab extending into the locking opening in locking engagement therewith.

2. The carton improvement defined in claim 1, wherein the locking tab is an integral portion of a male locking panel, the male locking panel being connected to the second panel flap by a fold line.

3. The carton improvement defined in claim 2, wherein the female locking panel includes a second locking opening and a second locking tab is connected by a fold line to the male locking panel, the second locking tab extending into the second locking opening in locking engagement therewith.

4. The carton improvement defined in claim 3, wherein the first and second locking tabs are at opposite ends of the male locking panel.

5. The carton improvement defined in claim 3, wherein the male locking panel partially overlaps the female locking panel.

6. A wrap-around article carrier, comprising:

opposite side panels connected to a top panel and a bottom panel;

the bottom panel being comprised of a first bottom panel flap connected to one of the side panels and a second bottom panel flap connected to the opposite side panel;

the first and second bottom panel flaps having spaced interior ends;

at least one female locking panel connected by a fold line to the first bottom panel flap, the female locking panel and the first bottom panel flap lying in different but substantially parallel planes, the female locking panel extending past the interior end of the first bottom panel flap;

the female locking panel containing a locking opening therein;

a male locking panel connected to the interior end of the second bottom panel flap by a fold line; and a locking tab integral with the male locking panel and extending into the primary locking opening in locking engagement therewith.

7. A carrier as defined in claim 6, wherein the female locking panel includes a second locking opening and a second locking tab is connected by a fold line to the male locking panel, the second locking tab extending into the second locking opening in locking engagement therewith.

8. A carrier as defined in claim 7, wherein the first and second locking tabs are at opposite ends of the male locking panel.

9. A carrier as defined in claim 7, wherein the male locking panel partially overlaps the female locking panel.

10. A carrier as defined in claim 7, wherein the side panels include portions of heel cutouts, the heel cutouts extending into the first and second bottom panel flaps, the heel cutout in the first bottom panel flap being at least partially comprised of an opening originally occupied by the female locking panel.

11. A carrier as defined in claim 8, wherein the interior end of the first bottom panel flap includes at least one recess of substantially similar shape to the shape of the second locking tab, the second locking tab being positioned within said recess.

12. A carrier as defined in claim 10, wherein each side panel includes a sloped heel panel portion, the side panel portions of the heel cutouts being located in the sloped heel panel portions of the side panels.

13. A blank for forming a wrap-around carrier, comprising:

a centrally located top panel section;

a side panel section connected by a fold line to opposite edges of the top panel section;

a first bottom panel flap connected by a fold line to one of the side panel sections and a second bottom panel flap connected by a fold line to the other side panel section;

the first and second bottom panel flaps having outwardly extending ends;

at least one female locking panel connected by a fold line to the first bottom panel flap, the female locking panel fold line being spaced from the end of the first bottom panel flap and being substantially parallel to the first bottom panel flap fold line;

the female locking panel containing a locking opening therein;

a male locking panel connected by a fold line to the end of the second bottom panel flap, the male locking panel fold line being substantially parallel to the second bottom panel flap fold line; and a locking tab integral with the male locking panel, the locking tab extending into the locking opening in locking engagement therewith in a carrier formed from the blank.

14. A carrier blank as defined in claim 13, wherein the female locking panel includes a second locking opening and a second locking tab is connected by a fold line to the male locking panel, the second locking tab extending into the second locking opening in locking engagement therewith in a carrier formed from the blank.

15. A carrier blank as defined in claim 14, wherein the first and second locking tabs are at opposite ends of the male locking panel.

16. A carrier blank as defined in claim 15, wherein the side panel section connected to the second bottom panel flap includes a portion of at least one heel cutout, the heel cutout extending into the second bottom panel flap, the female locking panel being of such size and shape that when the female locking panel is folded out of the blank through an angle of 180°, the opening created by such folding functions as a heel cutout in a carrier formed from the blank.

17. A carrier blank as defined in claim 14, wherein the end of the first bottom panel flap includes at least one recess of substantially similar shape to the shape of the second locking tab, whereby the second locking tab is positioned within said recess in a carrier formed from the blank.

* * * * *